US005405046A

United States Patent [19]

Garcia Rovira et al.

[11] Patent Number: 5,405,046

[45] Date of Patent: Apr. 11, 1995

[54] EXTENDABLE MODULUS FOR ADVERTISING PURPOSES FOR PACKAGED PRODUCTS DISPENSER MACHINES

[76] Inventors: José R. Garcia Rovira; Rafael I. Chacon Sevila, both of Avda. Maisonnave 27, 03003, Alicante, Spain

[21] Appl. No.: 965,396

[22] PCT Filed: Apr. 15, 1992

[86] PCT No.: PCT/ES92/00033

§ 371 Date: Feb. 17, 1993

§ 102(e) Date: Feb. 17, 1993

[87] PCT Pub. No.: WO92/18954

PCT Pub. Date: Oct. 29, 1992

[30] Foreign Application Priority Data

Apr. 17, 1991 [ES] Spain ..... 9100989

[51] Int. Cl.[6] ..... G07F 11/00

[52] U.S. Cl. ..... 221/13; 221/155

[58] Field of Search ..... 221/93, 92, 155, 2, 221/7, 8, 9, 12, 13, 112; 186/52

[56] References Cited

U.S. PATENT DOCUMENTS

| | | | |
|---|---|---|---|
| 777,414 | 12/1904 | Heberling | 221/155 |
| 3,010,607 | 11/1961 | Probasco | 221/93 |
| 3,156,340 | 11/1964 | Arkes | 221/2 |
| 3,298,568 | 1/1967 | Le Brocq | 221/155 |
| 4,326,643 | 4/1982 | Bayne et al. | 221/13 |
| 4,717,043 | 1/1988 | Groover et al. | 221/13 |
| 4,847,764 | 7/1989 | Halvorson | 221/2 |
| 5,222,624 | 6/1993 | Burr | 221/13 |

*Primary Examiner*—Kenneth W. Noland

*Attorney, Agent, or Firm*—Whitham, Curtis, Whitham & McGinn

[57] ABSTRACT

Extendable modulus for advertising purposes for packaged products dispenser machines, applicable for the promotion and increase of sales in public sales points, and also usable in an autonomous mode, comprised of at least one vertical channel (2) containing the packaged products in promotion (3) in pile arrangement, an expelling system situated internally under the channel (2), an illuminating device (4) and a front cover (5) having an approximately semicylindrical shape in order to magnify the visualization grade of the advertisement, both (4 and 5) in a vertical and front arrangement and in accordance with the front face of the channel (2). The operation of the modulus starts once the activating signal (5) reaches the corresponding relay (R) which in turn through an electronic circuit activates the dispenser system thereby expelling the lower package of the pile towards the collecting tray (6). Optionally the modulus may be provided with lateral channels and an upper exhibitor, a turn-plate placed under the channels, and the connection of the modulus to a display screen such as the screen of a computer or a television receiver.

14 Claims, 3 Drawing Sheets

EXTENDABLE MODULUS FOR ADVERTISING PURPOSES FOR PACKAGED PRODUCTS DISPENSER MACHINES

The present invention, as indicated in the title, refers to an extendable modulus for advertising purposes for dispenser machines of packaged products which can be used both as dependent to said machines as well as in an independent way.

Advertising, for promoting and increasing of product sales, is one of the most important subjects to deal with for any business or businessman. There are products for which advertising must be made or it is recommended to be made at the sales points, be it for the particular characteristics of the product, or for the manner of the sales to the public, etc.

BACKGROUND OF THE INVENTION

For sales promotion of such kind of products, it is in many occasions necessary to assign persons for this objective in exchange for economic compensation, which can become very expensive when there are many sales points, in other cases the client receives, when the product is purchased, some signal such as a coupon, a voucher, a code, etc. which he later sends to the promoting company and afterwards receives a response of the promotion in form of gifts or the like. This process turns out to be slow and since it needs direct participation of the client and is ineffective in many cases.

The modulus, according to the invention, eliminates the problems hereinabove mentioned and provides the possibility of carrying out the promotion and the advertising at the sales point itself and delivering the object to be given as a gift to the client without a need for personnel or any further procedures between the promoting company and the client.

DESCRIPTION OF THE INVENTION

This invention comprises a modulus that is useful for promoting and increasing the sales of a particular product at a public sales point, in such a way that the user, when purchasing a commercial product from a dispenser machine, for example, tobacco, drinks or the like, will receive, through said modulus, another package which contains a gift or any other advertising or promotional object such as key-rings, lighters or similar objects. According to this function, the modulus is electrically connected to the main dispenser machine, and when the user activates said dispenser machine, the modulus is activated in order to dispense the gift packet. It is also possible to use the modulus in an independent manner, that is to say, without being connected to another dispenser machine, expelling the objects to be promoted when a button corresponding to the product in promotion is pressed, resulting in the sending of the relevant signal to the electronics circuit of the modulus, which in turn activates a small motor incorporated in its dispensing mechanism giving rise to the expelling of the product in promotion. In the case of an independent operation, the modulus can be activated for the delivery of the gift by introducing a coupon, voucher, card, token or the like or in some cases, coins or bank notes.

The modulus comprises at least one vertical channel where the products in promotion are stacked, an expelling system placed under the channel in such a manner that the lowest product rests on a base plate which said expelling system provides. On the front side, the channel has, along a longitudinal direction, an illuminating device and a transparent front cover of an approximate semicylindrical shape, both of them placed according to the shape of the front side of the channel. In the lower part, the modulus has a support base which comprises a tray for the deposit of the expelled product. Said support base includes, at the lower part, circuitry which corresponds to the control of its functioning.

Optionally, the modulus can have more than one channel, up to a maximum number of lateral channels in such a form that at any side, channels can be arranged and the advertising effects be seen from any angle around the modulus. In the same manner the advertising can be exposed at the top of the modulus.

EXAMPLE OF A PREFERRED EMBODIMENT

Figure 1:
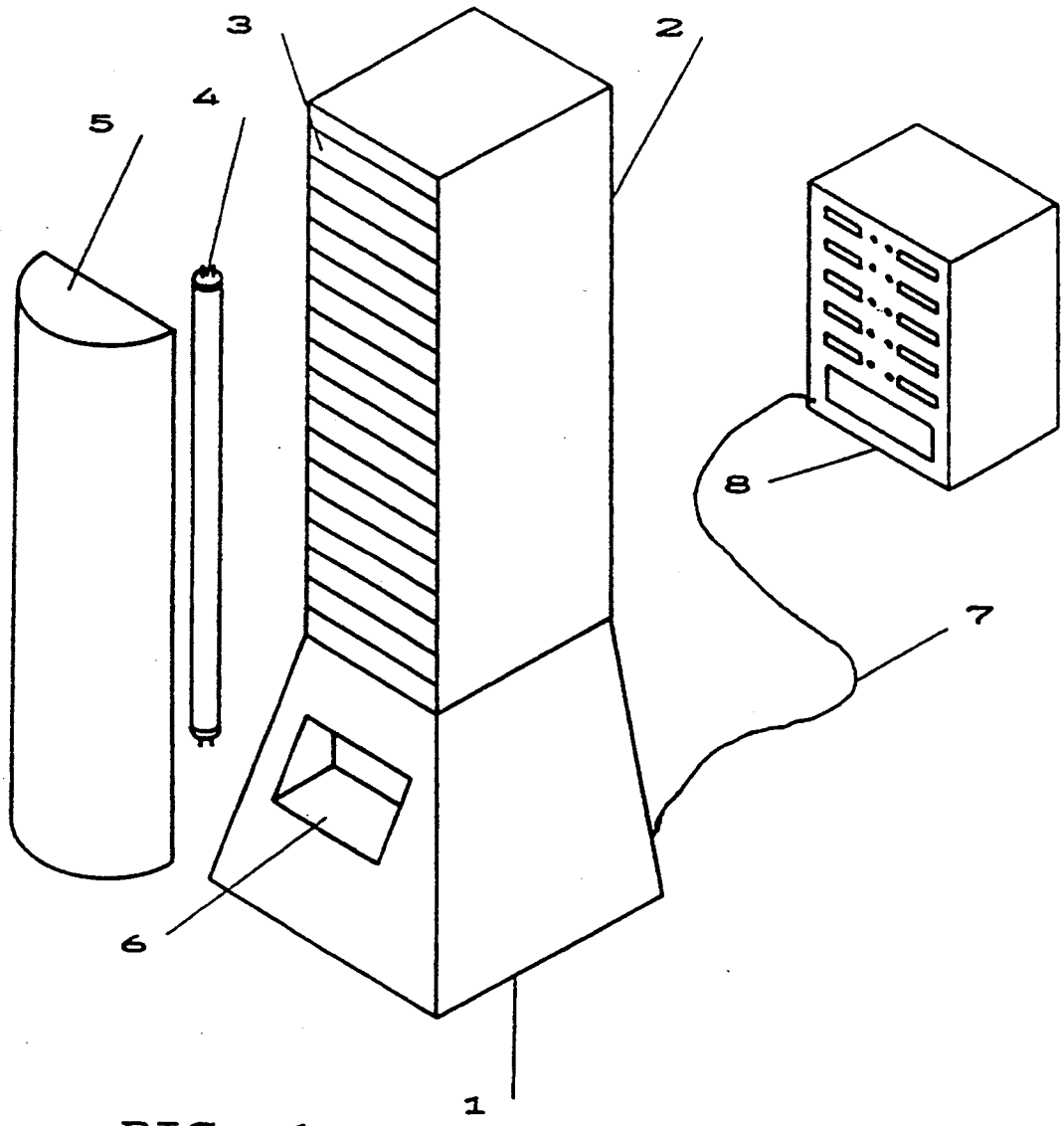
FIG. 1 shows a perspective view of an examplary embodiment of the modulus of the present invention along with an illuminating device and the front cover, represented as separate parts.

As it has been hereinabove mentioned, the extendable modulus for advertising purposes (1) comprises at least one vertical channel (2) in which the products in promotion (3) are stacked, an illuminating device (4), preferably with a length according to the length of the channel (2), a front cover (5) being transparent and in an approximately semicylindrical shape whose length is also in accordance to the length of the channel (2).

Inside the modulus, and placed under the pile of the packages in promotion, there is an expelling system (not shown in the figure) in such a form that the lower package rests on a base plate provided by said system, said package being prepared to be expelled. Once the package is expelled, it is then deposited on a tray (6), to which the client has access for collecting the package.

Figure 2:
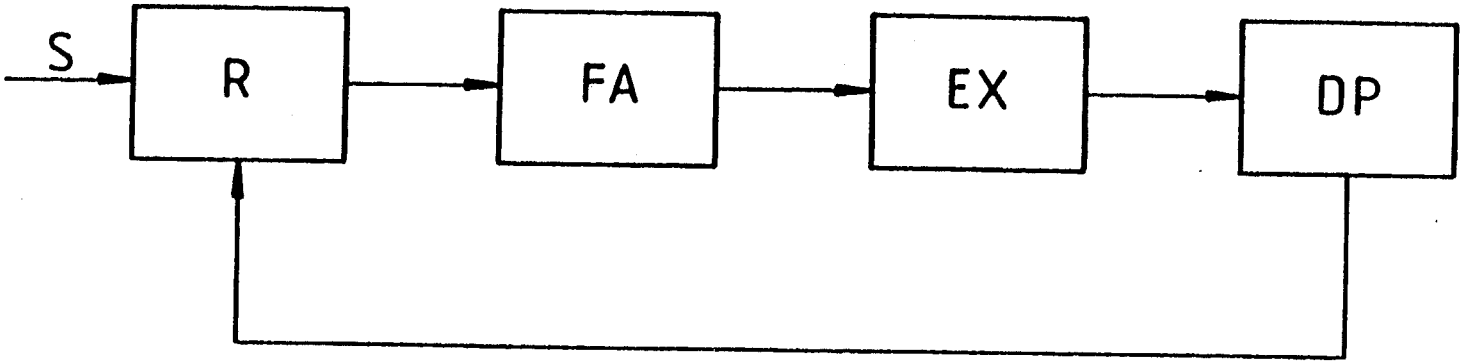
FIG. 2 is a block diagram showing the main stages in the operation of the modulus.

The modulus, once electrically connected by means of a cable (7) to the main dispenser machine (8), is put into operation in the following manner:

When the user purchases a product from the main machine (8), this latter sends at the same time a signal to the modulus (1) so that the modulus starts its operation (see FIG. 2). Said signal (S) goes toward a series of relays (R) bringing into action the corresponding relay which in turn makes possible the supply of electrical energy from the mains to the power supply (FA), said power supply activates the motor of the expelling system placed under the pile of packages, resulting in the expelling of the gift package. The expelling is detected by means of a proximity detector (DP) placed along the path of the package in order to verify its exit. This detection gives rise to the deactivation of the corresponding relay, which is again turned back to standby position for the reception of the next signal.

In the case that the modulus operates in an autonomous manner, the signal is transmitted to the electronic circuit of the modulus by means of pressing of the corresponding button (or buttons) resulting in the expelling of the package in the same manner hereinabove described. In order for the pressing of the button to be effective, the user must introduce a coupon, or token or any other similar object which may have obtained at the time of the purchase of the main product.

Additionally, the modulus can be constructed on the basis of incorporating two or more channels, thus admitting a greater quantity of products in order to increase its service capacity.

As it can be observed from FIG. 1, the illuminating device (4) is placed between the front face of the channel (3) and the front transparent cover (5). In this way, by means of the illumination produced by the device (4) and the transparency of the cover, the advertisement is visualized in an intensified manner since said transparent cover having a semicylindrical shape acts as if it were a lens, magnifying the visualization of the advertisement, the latter being of changeable in order to provide the advertising of different products of interest.

Figure 3:
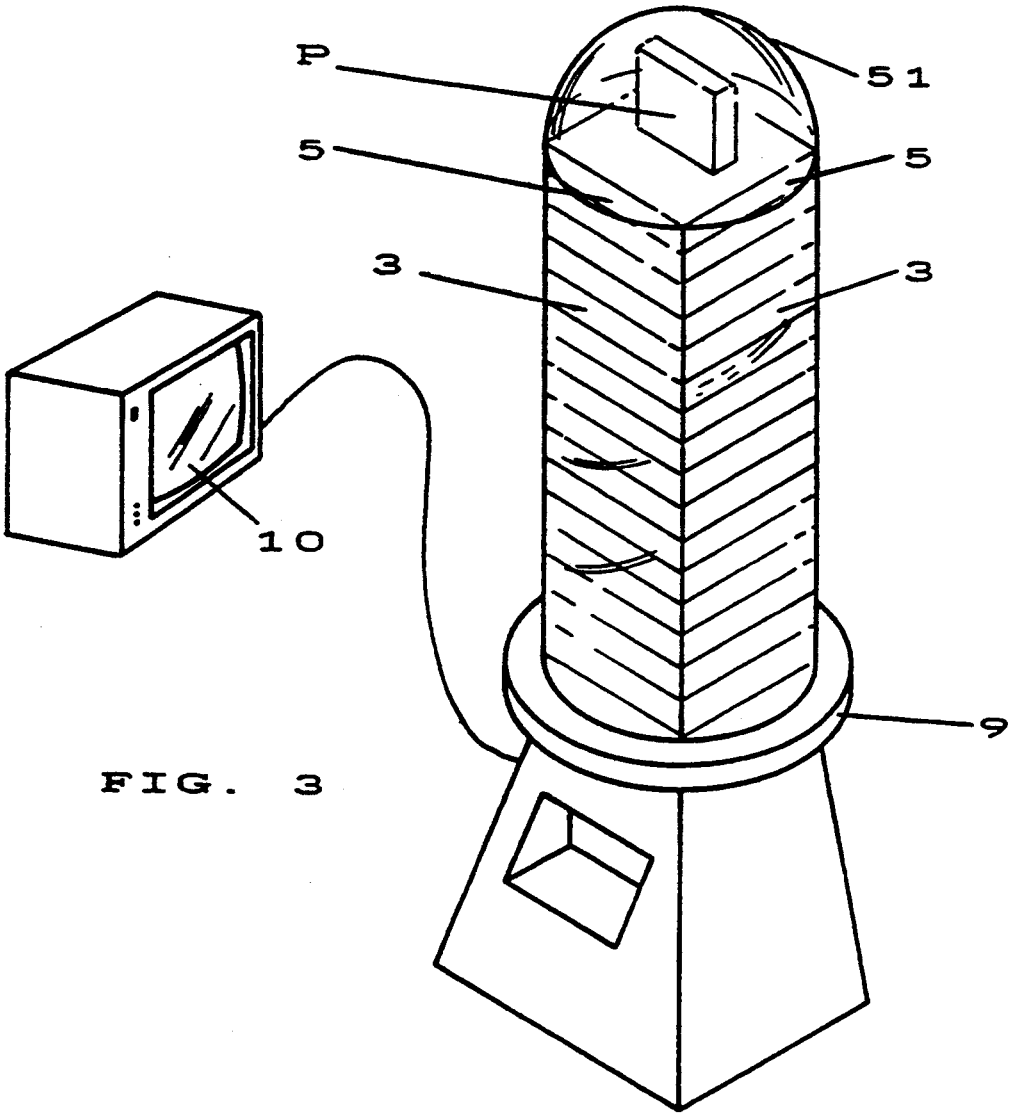
FIG. 3 is a perspective view of another example of an embodiment of the modulus showing the additional options of channels at the lateral sides, upper exhibitor, turn-plate and display screen, incorporated in said modulus.

As it can be observed from FIG. 3, the modulus may optionally be comprised of channels (3) placed on the lateral sides of said modulus with their corresponding transparent covers (5) illuminated by means of respective illuminating devices in such a manner that it makes possible the visibility of the products in promotion from any angle, as well as an upper exhibitor (51) also transparent, being totally or partly hollow, which is illuminated in the same manner described for the case of lateral channels. Said exhibitor (51) being placed on the upper side of the modulus, so that inside said exhibitor one or several products in promotion (P) are exposed.

Optionally, the modulus can comprise of a turn-plate (9) placed under the vertical column of the modulus which contains the channels (3), said column resting on the turn-plate (9), and said turn-plate being able to turn around its center, activated by means of a conventional motor so that with the revolution of the plate, the column which contains the channels (3) performs a continuous rotary movement in order to render possible the visibility of the products from every angle.

Another option of the invention is that it can be connected to a display screen (10), for instance, of a computer or of a television receiver in order to show through said screen, advertising messages previously recorded on video tapes or computer programs.

Having sufficiently described the nature of the invention, together with one form of putting it into practice, it only remains to be added that it is possible to introduce changes in form, materials, and disposition over all the invention or over the parts that it is composed of, as long as such alternations do not vary substantially the characteristics of the invention claimed as follows:

We claim:

1. An extendable modulus for advertising purposes for packaged products dispenser machines comprising at least one vertical channel in which the products in promotion are piled, an expelling system placed under the channel, an illuminating device and a semicylindrical, transparent front cover, said illuminating device and said front cover being of a vertical, longitudinal and frontal form in accordance with a front face of the channel and located in front of said front face of said channel, a lower support base comprising a tray on which the expelled product is deposited by said expelling system an electronic circuit including means for detecting a signal and activating said expelling system in response to detection of said signal, at least one proximity detector means responsive to the exit of the product in promotion, and means for returning said electronic circuit to a standby state in response to said proximity detector.

2. An extendable modulus, according to claim 1, wherein the electronic circuit comprises a power supply means for activating the expelling mechanism, and wherein said means for detecting a signal comprises a series of relays connected to receive said signals from a main dispenser machine and activate the power supply of the modulus.

3. An extendable modulus, according to claim 1, wherein the illuminating device is placed between the front face of the channel and the transparent front cover, whereby the illumination produced by said illuminating device and the transparency of the semicylindrical, transparent front cover intensifies the visualization.

4. An extendable modulus as recited in claim 3, wherein said front cover is changeable and includes a advertisement located to be visualized in a manner which is intensified by said front cover and said illuminating device.

5. An extendable modulus, according to claim 1, including at least one further vertical channel so that a greater quantity of products can be fit inside.

6. An extendable modulus as recited in claim 5, wherein said further vertical channel is located at a lateral side of said at least one vertical channel.

7. An extendable modulus, according to claim 1, further including a transparent exhibitor which is totally or partially hollow, and a further illumination device, whereby one or several products in promotion can be exposed in said transparent exhibitor.

8. An extendable modulus, according to claim 1, further including means for activating the modulus by the introduction of a coupon, voucher, card, token or the like, or in cases coins or bank notes, whereby the modulus is operated autonomously.

9. An extendable modulus, according to claim 1, wherein the modulus is in the form of a vertical column and further including a turn-plate under the modulus which contains the channels, said turn-plate being turnable around its center.

10. An extendable modulus as recited in claim 9, further including a motor coupled to said turn-plate for causing rotary motion of said modulus.

11. An extendable modulus, according to claim 1, further including a display screen means for display of advertising messages.

12. An extendable modulus as recited in claim 11, wherein said display includes a computer display.

13. An extendable modulus as recited in claim 11, wherein said display includes a television receiver.

14. An extendable modulus as recited in claim 6, further including a motor coupled to said turn-plate for causing rotary motion of said modulus.

* * * * *